US005186675A

United States Patent [19]

D. Stoddard

[11] Patent Number: 5,186,675

[45] Date of Patent: Feb. 16, 1993

[54] AIR VENT TOY

[76] Inventor: Robert D. D. Stoddard, 1095 W. 1060 North, Layton, Utah 84041

[21] Appl. No.: 794,040

[22] Filed: Nov. 19, 1991

[51] Int. Cl.[5] ..... A63H 13/00; A63H 3/06; A63H 33/00; G09F 19/08

[52] U.S. Cl. ..... 446/199; 446/178; 446/226; 446/490; 40/412; 40/212

[58] Field of Search ..... 446/199, 201, 203, 205, 446/210, 213, 198, 197, 192, 191, 190, 188, 185, 184, 183, 179, 178, 176, 220, 225, 22[illegible], 487, 488, 489, 490; 40/412, 212, 214, 217

[56] References Cited

U.S. PATENT DOCUMENTS

| | | | |
|---|---|---|---|
| 555,135 | 2/1896 | Walsh et al. | 446/210 |
| 2,348,250 | 5/1944 | Gardner et al. | 446/199 X |
| 2,911,745 | 11/1959 | Simon | 446/179 X |
| 3,071,892 | 1/1963 | Clark | 446/199 |
| 3,159,935 | 12/1964 | Rubens | 446/199 X |
| 3,346,978 | 10/1967 | Letsinger | 40/212 X |
| 3,465,471 | 9/1969 | Friedman | 446/179 |
| 4,292,755 | 10/1981 | Houn | 446/179 X |
| 4,765,079 | 8/1988 | Takahashi | 446/199 X |
| 4,920,674 | 5/1990 | Shaeffer | 40/212 |
| 5,125,177 | 6/1992 | Colting | 446/226 X |

FOREIGN PATENT DOCUMENTS

| | | | |
|---|---|---|---|
| 0081899 | 6/1983 | European Pat. Off. | 446/220 |

*Primary Examiner*—D. Neal Muir

*Attorney, Agent, or Firm*—Marcus G. Theodore

[57] ABSTRACT

An inflatable vent toy for an exhaust vent air outlet comprising: an inflatable balloon made of a flexible material patterned and shaped to suit the preference of a user having a base defining an air inlet with surrounding attachment structure to secure the base over the exhaust vent air outlet such that the air inlet is in communication with the vent air outlet to enable in-coming air from the vent to enter the base air inlet and fill the balloon in a first mode, and to escape and collapse in a second mode when the in-coming air from the vent stops.

14 Claims, 3 Drawing Sheets

AIR VENT TOY

BACKGROUND OF THE INVENTION

1. Field

This invention pertains to inflatable toys. In particular it relates to an inflatable toy associated with the exhaust of a forced air vent to inflate and deflate in response to the air flow flowing through said vent.

2. State of the Art

Inflatable toys are well known. For example, Ishiwa, U.S. Pat. No. 4,758,198 discloses a gas inflatable animal shaped toy with plural bladders and valves to contain an air supply which fills the bladders. Glazer, France No. 1,380,732 discloses an inflatable gas filled doll shaped toy. Sevylor, France No. 1,375,573 discloses an inflatable gas filled duck shaped toy.

Rudy, U.S. Pat. No. 4,964,827 discloses an inflatable flotation device for swimmers positioned over a user's upper arm which is shaped as an animal or bird. The device is filled with air and prevents a novice swimmer from sinking.

The above devices are all inflated from an external gas source entering the bladder via inflation nipples or valves. Nottingham et al., U.S. Pat. No. 4,898,561, discloses a self inflating toy with its own internal gas generation source secured within the toys membrane. The gas is generated by a chemical reaction when the chemicals are admixed within the toy.

Other toy shaped wind socks are known. They are designed to be flown in the wind via a string and act more as kites than gas bladder filled toys.

Also known are vent air diffusers and covers which divert heated or cooled forced air from central air vents into a room or hall.

None of the above inventions provides an inflatable decorative toy used in association with the air exhaust of a vent outlet which also acts as a gas diffuser.

SUMMARY OF THE INVENTION

The invention comprises an inflatable vent balloon toy structured to cover the exhaust vent and be filled by the air of a forced air heating or cooling system. Air passing through the vent causes the balloon to inflate in a first mode, and to collapse in a second mode when the air flow stops.

Exhaust vents typically have an air outlet through which heated or cooled air is vented into a room or enclosure. An inflatable balloon made of a flexible material patterned and shaped to suit the preference of a user has a base with an air inlet. The base has attachement means to position and secure the base to the vent such that gas passing through the vent air outlet enters the base air inlet and fills the balloon. The inflatable vent toy thus structured provides a pop up toy responding to the air flows passing through the exhaust vent.

The inflatable balloon may be constructed of a variety of plastic films and materials, such as polyvinyl chloride, polyethylene, polypropylene, polystyrene, and other resins used for wrapping and sealing. These lightweight films are selected not only for their buoyancy, but for their noise generating capabilities. For example, some films crinkle when they are inflated and deflated. Others are silent. By selecting a plastic film which provides movement noise consistent with the balloon theme, additional realism is added to the design. For example, balloons emerging from coffins described below may be constructed of a creaking film. Ghost shaped balloon, on the other hand, may be constructed of a silent film.

The inflatable balloon is generally shaped and patterned in a variety of patterns, shapes, or pictorial themes. For example, the balloon may be shaped as a ghost, goblin for Halloween, or another seasonal theme character to provide a decorative touch to a room or hallway. Other balloons may contain the picture of a star athlete or movie character and used as an advertising decorative piece.

Life size balloons shaped as people may be attached to a vent in front of a window for use as a security device to give the appearance that a room is occupied. When the balloon inflates and casts its shadow against a curtain, it provides the appearance of movement by occupants.

To provide movement, the balloon may include at least one exhaust port which allows a portion of the entering air to escape, causing the balloon to shimmer and move. This exhaust port must be sized and structured to retain sufficient air from the vent to allow the balloon to rise.

The invention may include separate base structure attached to the base of the balloon. The base structure defines an air inlet and is structured to attach to an exhaust vent such that the air inlet is in communication with the vent air outlet to allow air to pass through and into the balloon. The base structure is generally removably attached to the vent with attachment means such as magnets, ties, hooks, or straps.

The base structure may also be decoratively structured to accommodate the balloon theme. For example, the base structure may be sculpted as an open topped coffin out of which a balloon shaped monster emerges when the vent air fills the balloon. To insure that the balloon collapses within the base structure coffin, an elastic string with one end attached inside the balloon and the other end to the base structure coffin may be included to retract and store the collapsed balloon within the coffin.

The base structure may be adapted to rotatably mount to the vent outlet and allow the balloon to rotate and turn. A rotatable mount is preferably used where the balloon has exhaust ports which rotationally direct escaping air flows to cause the balloon to turn.

In another variation the base structure is attached to the balloon base via short string extenders which allow the balloon to float above the vent. This configuration is particularly attractive for use with ghost shaped balloons which float above the vent.

Additional movement to the balloon may be imparted by structuring the base to only partially cover the vent outlet. The air passing through the vent air outlet then partially enters and fills the balloon and the balance buffets and pushes along the balloon's exterior to provide air current eddies which imparts movement to the balloon.

To provide even more realism, the balloon may incorporate gas activated noise makers associated with the exhaust ports to produce a sound to suit the preference of a user when gas passes through the noise maker. Whistles or low moaning air activated sound devices are particularly effective with ghost shaped balloons. Other appropriate air activated noise makers may be included to match the appearance and character of the balloon design selected.

Dangling fringe or appendages attached to the exterior surface of the balloon may be included to accent movement when the balloon is inflated. This fringe and appendage structure is generally shaped consistent with the balloon pattern or theme to provide more realism. For example, arms with dangling fringe may be attached to a ghost shaped balloon to give a more ghostly appearance as the fringe and arms move when the balloon is inflated and vibrates with the air flow.

Balloons with more than one interconnecting compartment in communication with the base air inlet may also be incorporated to add more realism to the design. For example, arms may be made of compartments attached to a ghost shaped balloon to provide extending appendages from which fringe may be dangled. When the balloon is filled, the arms also are partially or fully filled and extended. Exhaust ports located in the arms then cause the arms and balloon to sway as air is released therefrom.

In another example, the balloon is structured as a skeleton, and additional muscle compartments are attached thereto which, when they inflate, transform the skeleton into a muscle man or other hulk form.

The balloon may be constructed of a flexible gas impervious material where it is desirable to obstruct the vent air flow into a room or hall. If heat transfer is to be minimized, an insulating type of material may be used to prevent heat loss. Balloon vent toys constructed of an insulating type of material are particularly useful for covering the vent exhaust outlet of a swamp cooler during winter months to prevent cold air from entering the room interior. These swamp cooler vent air outlets are generally located in the ceiling of a room. Therefore, not only are drafts prevented from entering the interior of the house, but the deflated balloon dangling from the ceiling vent air outlet can add an interesting decorative touch. In the summer, holes are then made in the balloon to allow cool air to enter and cool the interior of the house.

Alternatively, the balloon may be constructed of a flexible gas pervious material which diffuses air from the vent into the room or hall effectuating a more even heat transfer. Thus structured, the vent air toy acts as an air diffuser to prevent the blowing of curtains or room decorations while effectively transferring heat into a room or enclosure.

Gas pervious balloon materials, such as cloth, are preferred for use in rooms where small children may be present. These breathable materials prevent suffocation if the balloon happens to accidentally collapse over a child's head. Also, for use with children, the base air inlet is sized and structured to prevent entry of an infant's head. For example, for large balloon bases, cross bars or braces are incorporated over the inlet for this purpose. The gas pervious balloon materials also act as air inlet filters to screen large air particles.

A particularly interesting effect is accomplished when the vent toy balloon is constructed of a heat expandable plastic material. As heated vent air contacts the balloon, the balloon expands and grows in dimension giving a more ominous appearance for a character design, such as a monster, or a growth appearance for a tree or bush design.

The invention described above thus provides a combination decorative toy accent, security device, and air diffuser for use with any type of vent air outlet, such as those in cars, planes, or home central air heater/air conditioners.

DESCRIPTION OF THE ILLUSTRATED EMBODIMENTS

Figure 1:
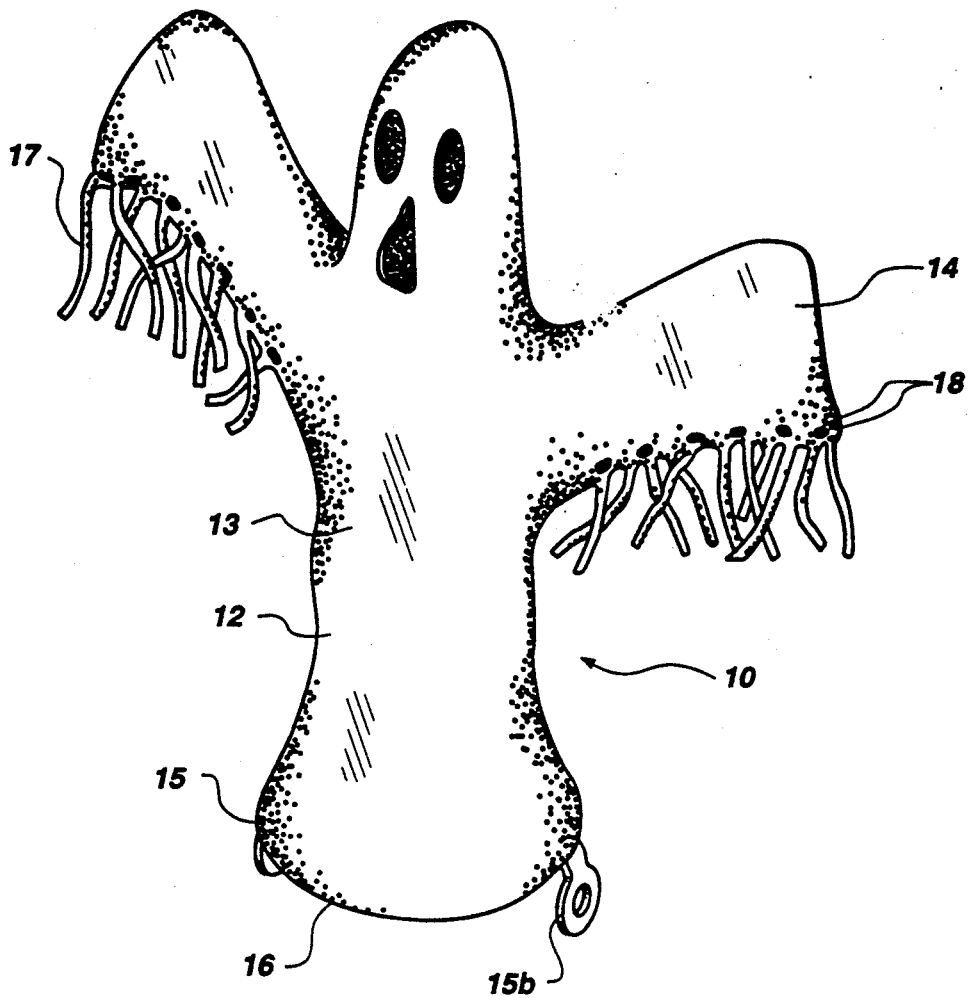
FIG. 1 is a perspective view of one preferred embodiment of the invention.
Figure 2:
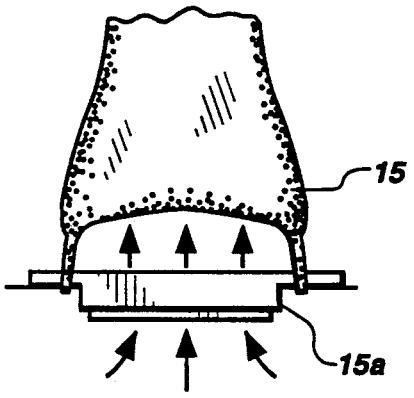
FIG. 2 is a perspective view of the base of the embodiment of the invention shown in FIG. 1.

FIG. 1 illustrates one embodiment of the invention 10 showing a balloon 12 shaped as a ghost body 13 with arms 14. The arms 14 are constructed of separate compartments in communication with the body 13 and filled by air entering the balloon 12. The balloon 12 has a base 15 defining an air inlet 16 which allows exhaust vent air to enter and fill the balloon 13. The base 15 is attached to a vent **15*a* with attachment means such as the hook strap 15*b* shown in FIG. 2**.

Dangling streamers 17 are attached to the arms 14 and move and sway as the arms 14 move. Exhaust ports 18 are positioned in the arms 14 above the point of attachment of the streamers 17 to direct air flow over the streamers 17 to cause them to move.

Figure 3:
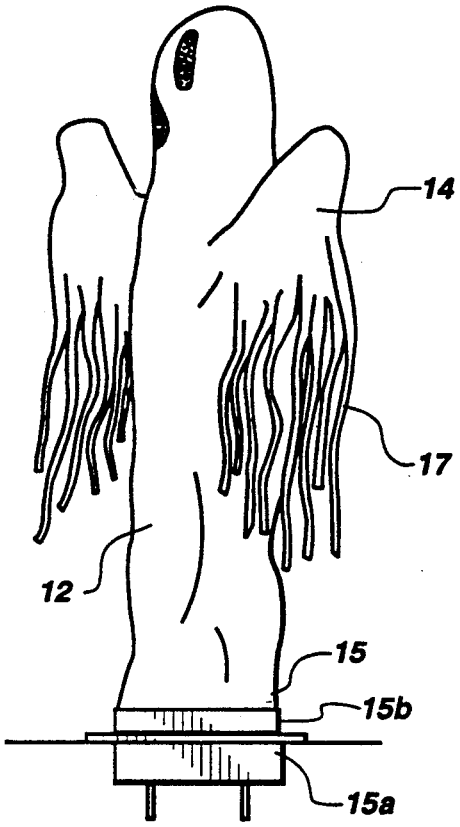
FIG. 3 is a side view of the embodiment shown in FIG. 1.

FIG. 3 is a side view of the of the embodiment shown in FIG. 1 attached to the vent **15*a***.

The balloon 12 and arms 14 are constructed of light weight plastic or cloth materials which are capable of support by the vent air exhaust flows entering the base inlet 16.

Figure 4:
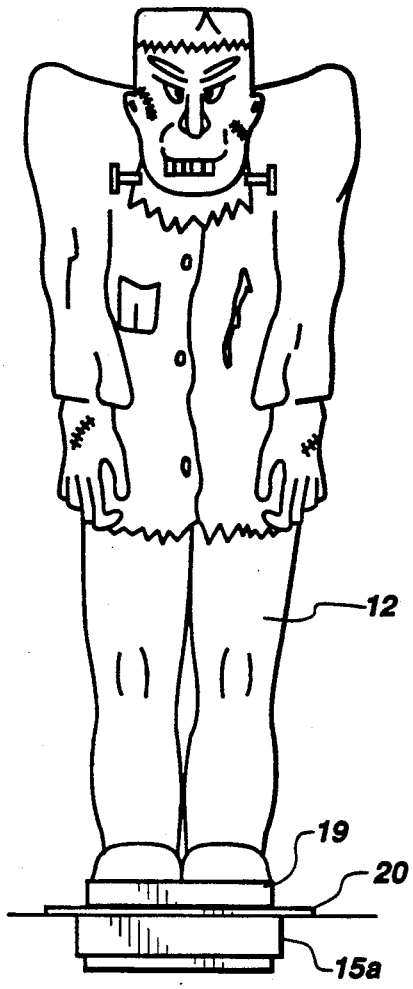
FIG. 4 is a perspective view of another preferred embodiment of the invention.

FIG. 4 is another embodiment of a balloon 12 structured as a monster. The balloon 12 has a separate base 19 rotatably attached to the base 15 with a rotating plate 20 having an air inlet (not shown). The plate 20 is affixed to the exhaust vent **15*a* via magnets 22 similar to those shown in FIG. 5. Associated with the exhaust ports (not shown) is an air activated whistle 21 which emits noise when the balloon 12 is filled. The balloon 12 is constructed of a heat expanding plastic which allows the "monster" to grow as the heated air fills the balloon 12**.

Figure 5:
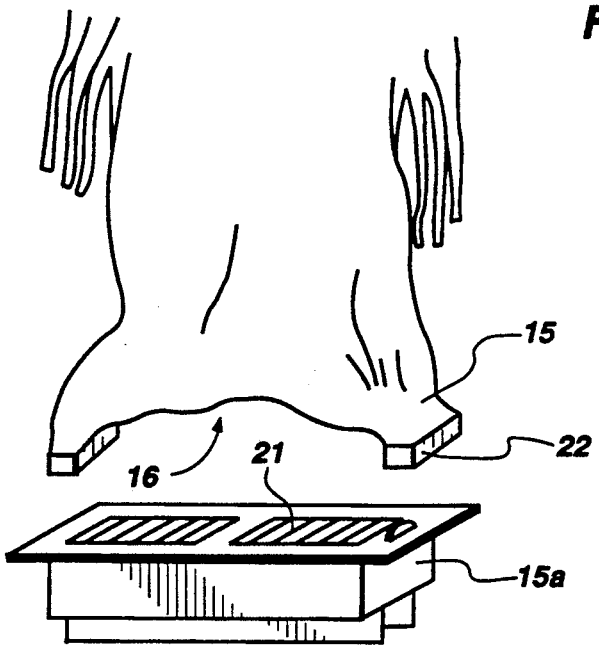
FIG. 5 is a perspective view of the base of the embodiment of the invention shown in FIG. 3.

FIG. 5 illustrates a balloon 12 with its base 15 attached to the vent **15*a* with magnets 22 such that the air inlet 16 is aligned with the vent 15*a* outlet 21**.

Figure 6:
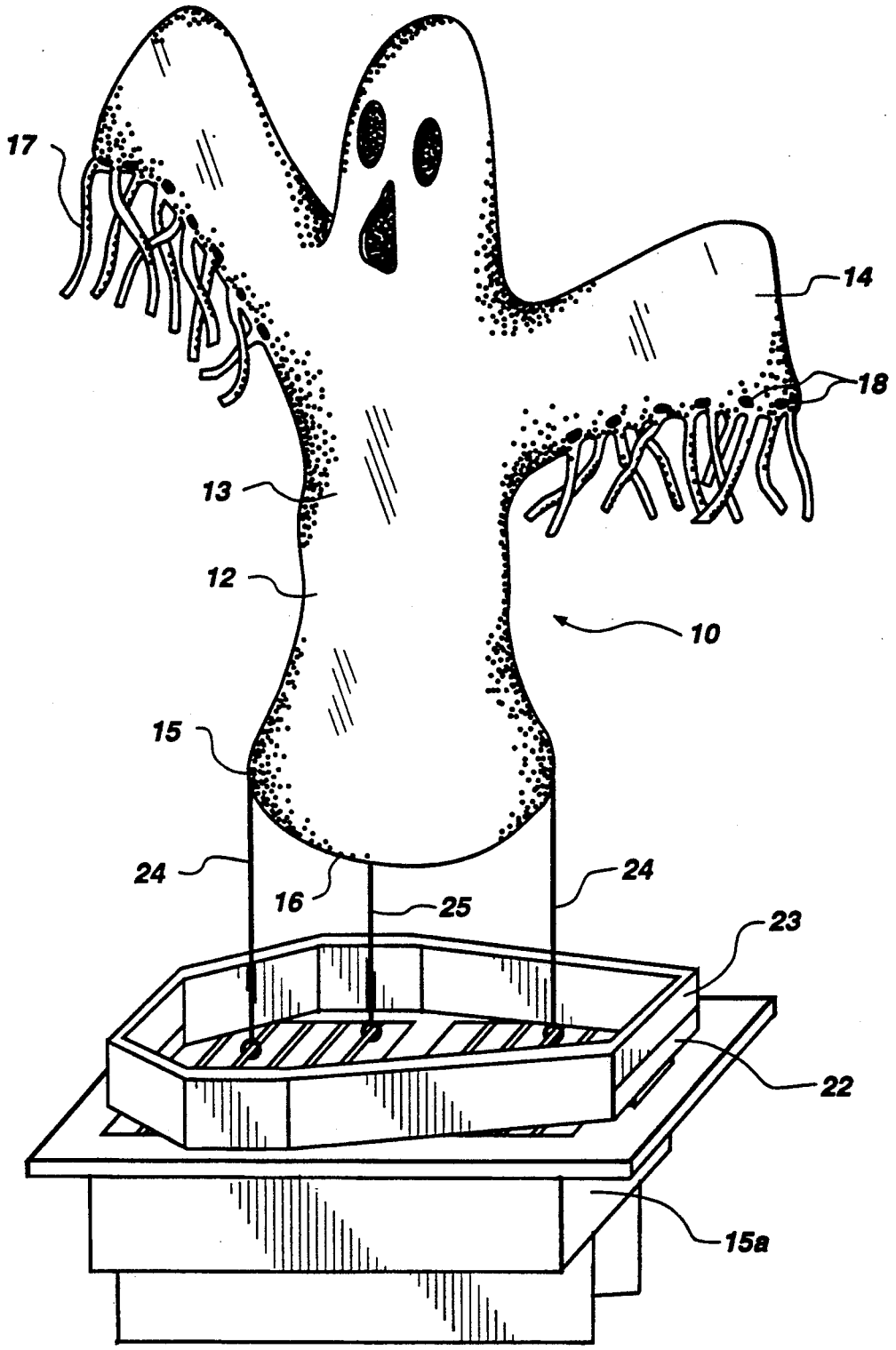
FIG. 6 is a perspective view of the base of another preferred embodiment.

FIG. 6 illustrates the balloon 12 shown in FIG. 1 shaped as a ghost body 13 with arms 14 adapted to enter and exit a base structure coffin 23 attached to the vent **15*a* with magnets 22. The coffin 23 defines an air inlet 24 which allows exhaust vent air to enter and fill the balloon 13 via the air inlet 16. The base 15 of the balloon 12 is attached to a vent 15*a* with strings 24 such that the inflated balloon 12 floats above the vent 15*a* when air passes through the vent outlet 21**.

A retractable elastic band 25 has one end attached to the vent **15*a* and its other end attached to the interior of the balloon 12 so that when the balloon is deflated, it is drawn back against the vent 15*a* and into the base structure coffin 23. Thus configured, the vent toy 10 pops out of the coffin 23 and floats above it when the exhaust vent air enters and fills the balloon 12 via the air inlet 16 to stretch the elastic band 25. When the exhaust vent air flow ceases, the elastic band 25 pulls the balloon 12 back into the coffin 23** until the air vent flow returns.

The balloon 12 is constructed of a plastic film which makes a rustling noise as the balloon 12 is filled. This sound mimics that of the coffin 23 opening.

Although this specification has made reference to the illustrated embodiments, it is not intended to restrict the scope of the appended claims. The claims themselves recite those features deemed essential to the invention.

I claim:

1. An inflatable vent toy covering an exhaust vent air outlet of a forced air heating or cooling system leading into a room enclosure, the flow of which is responsive to the temperature within said room enclosure comprising: an inflatable balloon made of a flexible material patterned and shaped to suit the preference of a user having a base defining an air inlet with surrounding attachment structure means releasalely securing the base over an exhaust vent air outlet such that when the air inlet is in communication with a vent air outlet to direct in-coming air from a vent to enter the base air inlet and fill the balloon in a first mode while allowing vented air to also enter the room, and when the in-coming air from a vent stops, the balloon collapses in a second mode.

2. An inflatable vent toy according to claim 1, wherein the balloon defines at least one exhaust port which allows a portion of the entering air in the balloon to escape causing the balloon to shimmer and move.

3. An inflatable vent toy according to claim 2, wherein the base is rotatably mounted to a vent air outlet allowing the balloon to rotate when inflated.

4. An inflatable vent toy according to claim 2, including at least one air activated noise maker associated with an exhaust port to produce a sound to suit the preference of a user when air passes through the exhaust port and noise maker.

5. An inflatable vent toy according to claim 1, including dangling fringe and structure shaped to suit the preference of a user attached to a exterior surface of the balloon which moves when the balloon moves.

6. An inflatable vent toy according to claim 1, wherein the balloon is constructed of a flexible gas impervious material.

7. An inflatable vent toy according to claim 1, wherein the balloon is constructed of a flexible gas pervious material.

8. An inflatable vent toy according to claim 7, wherein the flexible gas pervious material filters air passing therethrough.

9. An inflatable vent toy according to claim 1, wherein the balloon is constructed of a heat expandable plastic material.

10. An inflatable vent toy according to claim 1, wherein the base air inlet entirely covers a vent air outlet to obstruct a vent air outlet when the balloon is filled by in-coming air.

11. An inflatable vent toy according to claim 10, wherein the balloon is constructed of a flexible gas impervious material.

12. An inflatable vent toy according to claim 11, wherein the balloon is constructed of a flexible gas impervious insulated material.

13. An inflatable toy according to claim 1, including a base mount patterned and shaped to suit the preference of a user defining an air inlet removably attached to a vent outlet such that a vent outlet and air inlet are aligned, and a plurality of strings having one end attached to the base mount and the other end attached to the base of the balloon such that the balloon is lifted and suspended when vent air passes through the base mount air inlet and into the balloon base air inlet to fill the balloon.

14. An inflatable toy according to claim 1, including a retractable elastic string with one end attachable to a vent out outlet and the other end attached to the interior of the balloon which expands and allows the balloon to rise when filled with air from a vent air outlet, and contracts and retracts the collapsed balloon against a vent when air from a vent air outlet ceases.

* * * * *